US005690533A

United States Patent [19]

Harris et al.

[11] Patent Number: 5,690,533

[45] Date of Patent: Nov. 25, 1997

[54] AIRFOIL

[76] Inventors: Robert Dean Harris, 2014 Bennett Ave., Chattanooga, Tenn. 37404; David Edward Barry, 9222 Hopi Trail, Ooltewah, Tenn. 37363

[21] Appl. No.: 707,001

[22] Filed: Sep. 3, 1996

[51] Int. Cl.[6] ..... A63H 27/00

[52] U.S. Cl. ..... 446/34; 446/45; 473/569

[58] Field of Search ..... 273/420–428; 446/34, 35, 36, 45

[56] References Cited

U.S. PATENT DOCUMENTS

| | | | |
|---|---|---|---|
| D. 263,247 | 3/1982 | Harris | D21/82 |
| 2,899,773 | 8/1959 | Lockwood | 46/74 |
| 2,921,404 | 1/1960 | Lescher | 446/34 |
| 3,399,487 | 9/1968 | Siegler | 46/75 |
| 3,665,641 | 5/1972 | Henderson | 46/81 |
| 3,691,674 | 9/1972 | Thompson | 273/428 |
| 3,947,993 | 4/1976 | Hoppe | 273/428 |
| 5,013,277 | 5/1991 | Hufeld | 446/34 |
| 5,284,454 | 2/1994 | Randolph | 446/45 |
| 5,403,221 | 4/1995 | Savage | 446/45 |

FOREIGN PATENT DOCUMENTS

| | | | |
|---|---|---|---|
| 1572692 | 7/1980 | United Kingdom | 273/428 |

*Primary Examiner*—Mark S. Graham

*Attorney, Agent, or Firm*—Chambliss, Bahner & Stophel, P.C.

[57] ABSTRACT

An airfoil is disclosed that is adapted to be launched into the air using an elastomeric band. The device includes a nose portion that is generally in the shape of an elongate ellipsoid that has a front end and a rear end. An elongate rib depends from the rear end of the nose portion in a dkection generally along the long axis of the nose portion, and a pair of generally planar wings depend from the rib and from the rear of the nose portion. The plane of the first wing portion is generally parallel to and spaced apart from the plane of the second wing portion, and both wing portions have a tapered outer edge. The taper of the outer edge of the first wing portion is oppositely disposed to that of the second wing portion.

16 Claims, 2 Drawing Sheets

AIRFOIL

FIELD OF THE INVENTION

The invention relates to an airfoil or aerial toy that is adapted to be launched into the air, preferably by means of a launcher using an elastomeric band. More particularly, the invention relates to an airfoil or aerial toy that is adapted for particular spinning motions during the ascending and descending stages of its flight.

BACKGROUND OF THE INVENTION

Aerial toys that are adapted to be launched or catapulted into the air generally have been of one of two types. Some such toys are adapted to glide down from their maximum altitude, while others are adapted to descend in some type of spinning motion. Each type has its peculiar characteristics and deficiencies. The gliding toys are not generally intended to be launched or catapulted to a high altitude, because their flight characteristics will dictate a descent that is unpredictable or that takes them far away from the launch point. On the other hand, spin flight toys are generally difficult to launch to a high altitude, because the characteristics that permit a spinning descent will generally interfere with a launch to a high altitude. In addition, the mass of the toy, especially a spin flight toy, will have a significant effect on its flight characteristics. Generally, the ascending flight of a more massive toy will be easier to control than that of a less massive toy. However, the heavier toy will also tend to descend more rapidly than a lighter toy. Various techniques have been employed in attempts to take advantage of favorable flight characteristics, while addressing these and other physical deficiencies.

One type of spinning toy is designed to have descending flight characteristics that are similar to that of a helicopter. Examples of such toys are described in U.S. Pat. No. 3,399,487 of Siegler and U.S. Pat. No. 5,284,454 of Randolph. Each of these toys is provided with a generally planar body portion having a pair of folding wings that are adapted for unfolding from a closed position that is in alignment with the body portion to an open position that is perpendicular thereto. Each such toy is adapted to be launched vertically in a folded configuration using an elastomeric band. After launch and as the toy begins to fall, however, the wings unfold to the perpendicular configuration and the toy spins down in the manner of a helicopter.

Other types of spinning toys are designed to spin about any of several axes defined by their structural configurations. Thus, for example, U.S. Pat. No. 5,403,221 of Savage describes a flat, thin, lightweight toy that is adapted for being launched vertically using an elastomeric band. This toy has a flat elliptical-shaped head portion and a flat depending taft portion which together resemble an oval intersecting a triangle. The Savage toy is comprised of a planar, rigid material such as expanded or extruded polystyrene that is overlain with a flexible, protective outer surface member such as polypropylene packaging tape. The outer surface member overlaps the underlying rigid member so as to form an aerodynamic edge around the periphery of the rigid member. Because the Savage toy has a height greater than its width and a surface area of the head that is greater than that of the tail, it will spin, upon being launched vertically, in a flat plane about its shortest axis, and it will descend in a spiral path, accompanied by a spin about its longest axis. The Savage toy is of fairly simple construction, but it is intended to be constructed of very lightweight materials. Therefore, it may be quite fragile and not as durable as desired. In addition, since the Savage toy is designed to rotate about the short axis of its flat surface upon launch, it seems unlikely that it could attain a high altitude. Finally, the rotation about the short axis of this toy during the ascent stage of its flight presents a large surface area to any wind that may be present. This coupled with its low weight would seem to preclude ready control of its launch path.

U.S. Pat. No. 3,665,641 of Henderson describes a toy that may be more durable than the Savage toy. The Henderson toy is generally shaped like a tear-drop, having a flat upper side and a substantially flat lower side. The rear end of the toy is rounded and the side edges are diagonally tapered to a point at the front end. The lower side is provided with a rearwardly bent hook at the front end and an arcuate bulge that extends from behind the hook to approximately the longitudinal center of the body. The rear portion of the lower side of the toy is flat like the upper side. The toy of Henderson ascends upon launch in a flat plane, but as it descends, it travels in a helical path while spinning about its long axis. The Henderson toy is a rigid toy, preferably made of aluminum, wood or plastic. Such a toy might pose a danger of injury to a bystander, if it is launched in his direction.

U.S. Pat. No. 3,947,993 of Hoppe describes a flying toy in the form of an airfoil having an extremely complicated surface architecture. This toy comprises an elongated body having a nose portion, a mid-section and a trailing edge portion, and it includes a plurality of curved surfaces which vary more-or-less constantly in configuration from the nose portion rearwardly along the full longitudinal length of the elongated body. Certain of these surfaces promote spinning of the toy about its long axis during both its ascending and its descending flight, while other surfaces cooperate to spin the toy, as it descends, about its center of gravity along a second axis which traverses the long axis.

All of these toys have certain undesirable characteristics, and it would be desirable if a toy could be developed that would overcome these and other failings of previously known toys.

OBJECTS AND ADVANTAGES OF THE INVENTION

Accordingly, it is an object of the invention claimed herein to provide an airfoil or an aerial toy that is capable of being launched into the air using an elastomeric band, and which is capable of reaching a relatively high altitude in a controlled flight. It is another object of the invention to provide such a device that will descend from its maximum altitude at a relatively slow rate and in a predictable fashion. It is yet another object of the invention to provide such a device that will exhibit interesting and amusing flight characteristics both in the ascending and the descending stages of its flight. Mother object of this invention is to provide such a device that is of a relatively simple design that may be manufactured economically. A further object of this invention is to provide such a device that can be made from flexible plastic materials that will reduce the risk of injury to a bystander if the device is mishandled or misused. It is yet another object of this invention to provide an airfoil that may be used to deliver seeds for planting in a forest or other remote area.

Additional objects and advantages of this invention will become apparent from an examination of the drawings and the ensuing description.

SUMMARY OF THE INVENTION

Accordingly, the invention comprises an airfoil or an aerial toy that is adapted to be launched into the air using an elastomeric band. This device includes a nose portion that is generally in the shape of an elongate ellipsoid, said nose portion having a front end and a rear end. The device also includes an elongate rib depending from the rear end of the nose portion in a direction generally along the long axis of said nose portion, and a pair of generally planar wing portions. Each of said wing portions depends from the rear end of the nose portion, and from the rib, and has a tapered outer edge. The plane of the first wing portion is generally parallel to and spaced apart from the plane of the second wing portion, and the taper of the outer edge of the first wing portion is oppositely disposed to that of the second wing portion.

In order to facilitate an understanding of the invention, the preferred embodiment of the invention is illustrated in the drawings, and a detailed description thereof follows. It is not intended, however, that the invention be limited to the particular embodiment described or to use in connection with the particular apparatus illustrated herein. Various changes are contemplated such as would ordinarily occur to one skilled in the art to which the invention relates.

DESCRIPTION OF THE PREFERRED EMBODIMENTS

Figure 1:
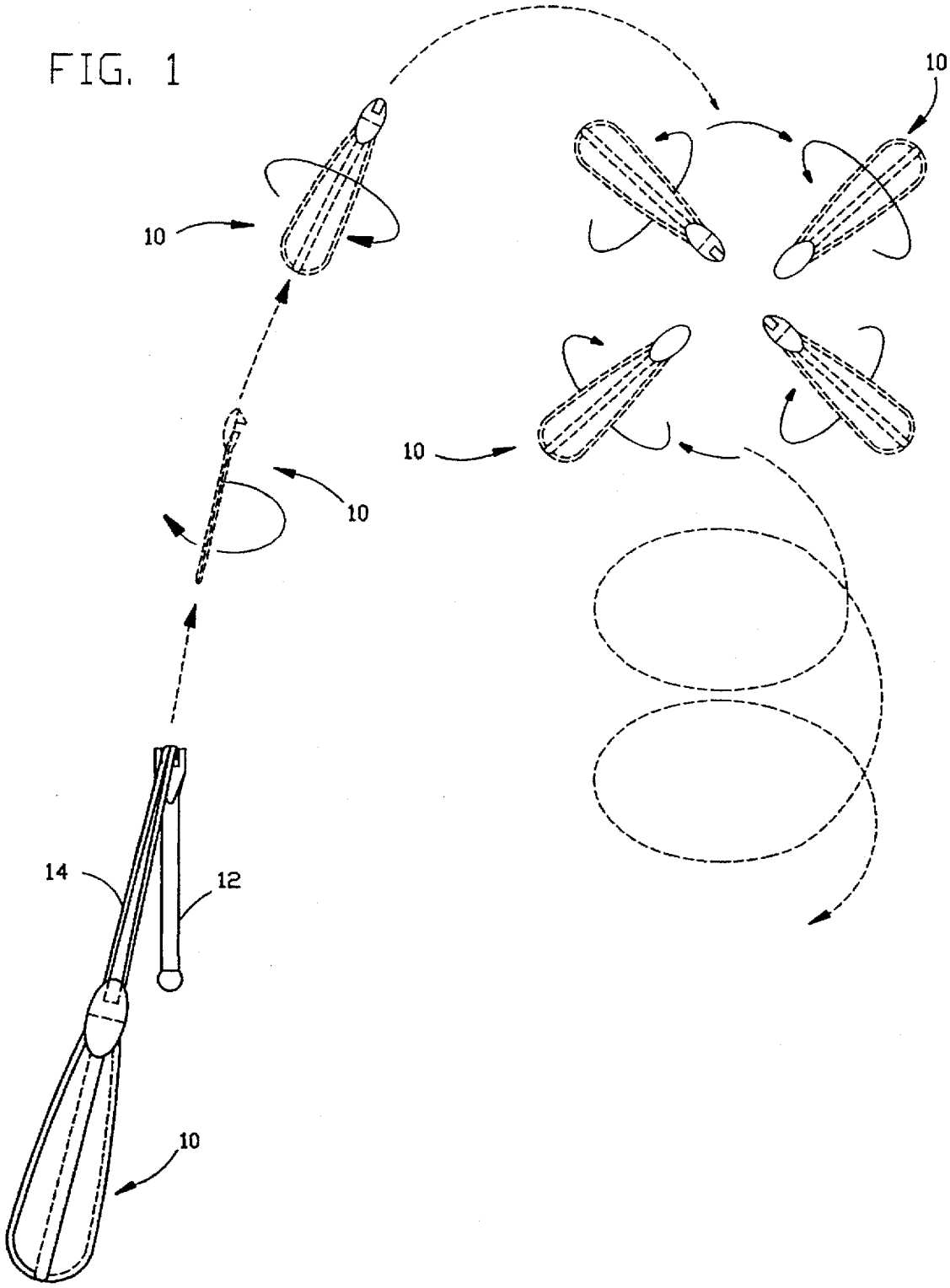
FIG. 1 illustrates a preferred means of launch of the preferred embodiment of the invention, as well as its ascending and descending flight characteristics.

Referring now to the drawings, FIG. 1 illustrates a preferred launch of aerial toy or airfoil 10 using stick-launcher 12 employing elastomeric band 14. This launcher is of the type that is comprised of a stick-like structure 12 with an elastomeric band 14 affixed at one end so as to form a loop. It is adapted to be held in one hand by a user while the other hand is used to pull the toy back against the tension of the elastomerie band. Of course, other types of launchers may be used, such as the slingshot type that is illustrated in U.S. Pat. No. 3,665,641 of Henderson. Airfoil 10 may also be launched by mechanical means such a spring-loaded launcher, or it may be launched by dropping it from an aircraft, or by any other suitable means now known or subsequently developed. The airfoil may also be launched by throwing it into the air, although generally greater altitudes, and hence longer flight times, may be obtained when the airfoil is launched from the Found using an elastomeric band. Preferably, the toy will be launched vertically or nearly so, and in such case and depending upon wind conditions, its flight will not typically carry it an inconvenient distance for retrieval from the launcher.

Referring now to FIGS. 2 through 5, it can be seen that the preferred embodiment 10 of the invention includes nose portion 16 that is generally in the shape of an elongate ellipsoid, with a curved or rounded front end 18 and a similarly curved or rounded rear end 20.

Figure 3:
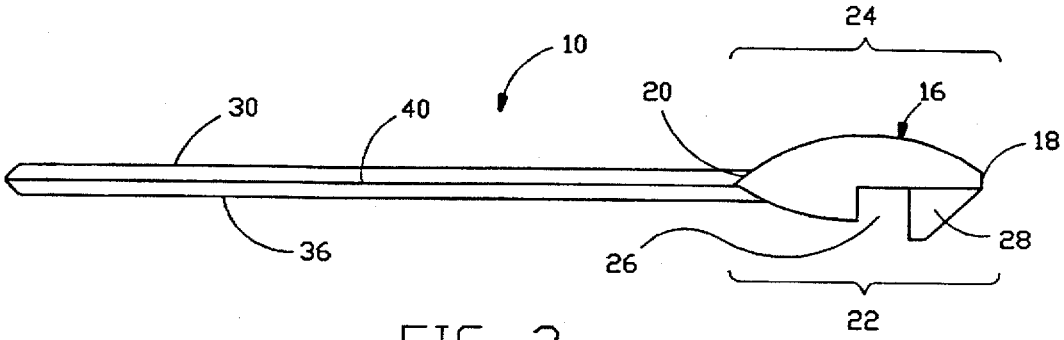
FIG. 3 is a side view of the device of FIG. 2.

As shown in FIG. 3, the nose portion 16 of device 10 has a first side 22, which may be considered to be the lower side, and a second side 24, which may be considered to be the upper side. Preferably, the nose portion has a notch 26 across the short axis of the first side near the front end, and an appendage 28 adjacent to said notch, which notch and appendage are adapted for receiving the elastomeric band of a launcher.

Figure 2:
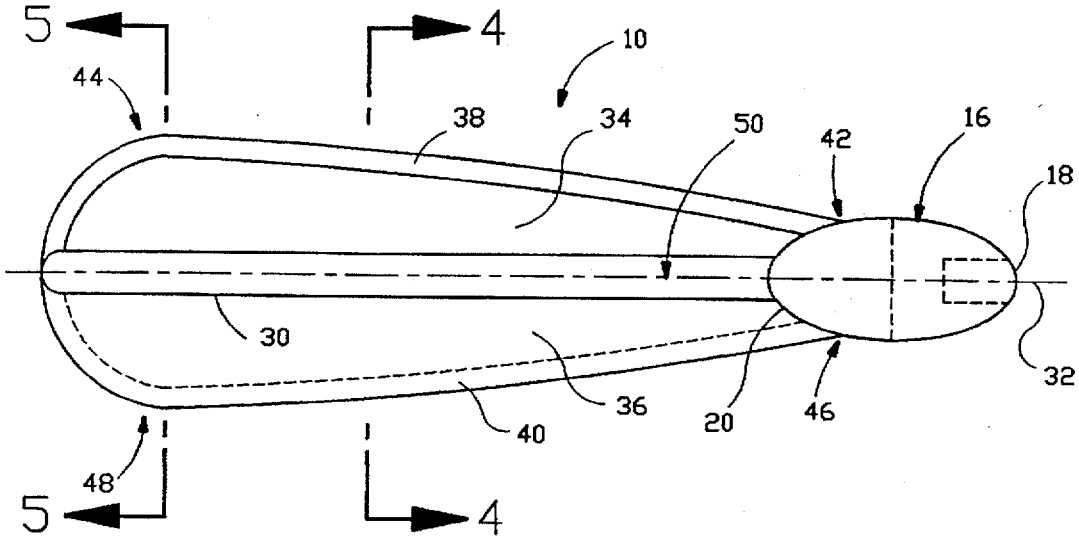
FIG. 2 is a plan view of a preferred embodiment of the invention.

Device 10 also includes an elongate rib 30 that depends from the rear end 20 of nose portion 16 in a direction generally along the long axis of said nose portion (which is identified by centerline 32 in FIG. 2). Device 10 also includes a first generally planar wing portion 34 and a second generally planar wing portion 36. The wing portions are essentially identical, although they are disposed differently with respect to rib 30, as will be subsequently explained. Each of the wing portions depends from rib 30 and from rear end 20 of the nose portion. Furthermore, each wing portion has a tapered outer edge, such as outer edge 38 of first wing portion 34 and outer edge 40 of second wing portion 36. As shown in the drawings, especially in FIG. 2, tapered outer edge 38 extends from the rear end 20 of nose portion 16, where wing portion 34 attaches thereto, all the way around the outer periphery of wing portion 34 to the end of rib 30. Similarly, tapered outer edge 40 of wing portion 36 extends from the rear end 20 of nose portion 16, where wing portion 36 attaches thereto, all the way around the outer periphery of wing portion 36 to the end of rib 30. Preferably, as shown in FIG. 2, each of the wing portions is of increasing width from a first point adjacent to the nose portion to a second point near the end of the rib away from the nose portion. Thus, wing portion 34 is of increasing width from first point 42 adjacent to the nose portion to second point 44 near the end of rib 30 away from the nose portion. Similarly, wing portion 36 is of increasing width from first point 46 adjacent to the nose portion to second point 48 near the end of rib 30.

Figure 4:
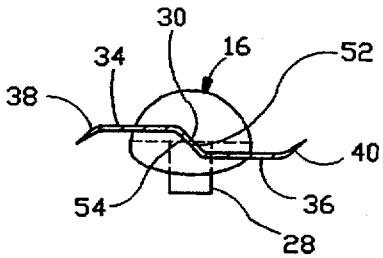
FIG. 4 is a sectional view of the device of FIG. 2, taken along the lines 4—4 of FIG. 2.
Figure 5:
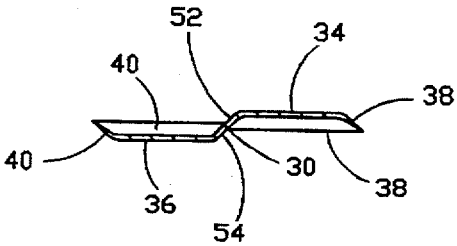
FIG. 5 is a sectional view of the device of FIG. 2, taken along the lines 5—5 of FIG. 2.

As shown in FIGS. 4 and 5, the plane of first wing portion 34 is generally parallel to and spaced apart from the plane of second wing portion 36, and the taper of the outer edge 38 of the first wing portion is oppositely disposed to that of the second wing portion. It is believed that this wing configuration, coupled with the nose configuration described and illustrated herein, is responsible for the dual spin action of the airfoil that is illustrated in FIG. 1.

When launched using an elastomeric band, the preferred embodiment of the invention illustrated in the drawings is capable of attaining an altitude of more than one hundred feet, and its total flight may last for more than a minute. As FIG. 1 shows, the preferred device will rotate about an axis defined by its rib as it ascends after launch to its maximum altitude. Upon reaching its maximum altitude, the airfoil will stall and will assume a slightly nose-down attitude, of about 20° with respect to the horizontal, as it descends. Furthermore, it will rotate about an axis defined by its rib as well as about an axis passing through its center of mass and generally through the center of mass of the Earth as it descends from its maximum altitude. The center of mass of the preferred embodiment illustrated in the drawings is located on the rib just behind the nose portion. Generally, it has been found that the rate of spin about the rib is approximately four times the rate of spin about the axis through the centers of mass. As shown in FIG. 2, the center of mass of airfoil 10 is at point 50. Therefore, preferably approximately 30–49% of the total mass of the toy, and more preferably approximately 35–45%, is in the nose portion.

Good results have been obtained when the airfoil is provided in a total length of about 5.75 inches and a total width across the widest part of the wing portions of about 1.625 inches. However, smaller or larger versions of the airfoil may also be provided. Preferably, the airfoil is manufactured for use as a toy from a flexible, plastic material by injection molding or blow molding. Good results have been obtained when the toy is made from polyethylene or polypropylene, although the toy may also be made by a foam injection molding process from urethane foam or styrene foam that is coated with a resin or other material to enhance its strength. It may be provided in any color, including fluorescent and phosphorescent colors. It may also be provided with decals or other forms of surface ornamentation.

It may even be equipped with one or more small electric lights powered by a small battery in the nose portion.

Preferably, the toy is made by injection molding from polyethylene in the dimensions recited above. Such a toy will preferably have a total weight of about seven grams. The nose portion will therefore have a weight of preferably about 2.10–3.43 grams, and more preferably about 2.45–3.15 grams.

In another embodiment, the invention may be made from paper, cardboard or other similar material. In such embodiment, it may be necessary to add mass to the nose portion to provide the preferred mass distribution. If made from a biodegradable material, the airfoil may be weighted in its nose portion with seeds for trees or other plants. A small amount of starter fertilizer or other organic nutrient material may also be provided. Such embodiment of the invention may be launched into a forest or other area to be seeded, or it may be dropped from an aircraft. Upon landing on the ground, the airfoil will degrade and release the seeds.

Preferably, rib 30 provides a pair of angled substantially planar transitions or transition segments 52 and 54 (see FIGS. 4 and 5) from the first wing portion to the second wing portion. It is believed that preferred results may be obtained when these transition segments are parallel and are disposed at an angle within the range of about 30° to about 60°, and more preferably about 45°, between the plane of the first wing portion and the plane of the second wing portion.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. An aerial toy that is adapted to be launched into the air using an elastomeric band, said toy including:

(a) a nose portion that is generally in the shape of an elongate ellipsoid, said nose portion having a front end and a rear end;

(b) an elongate rib depending from the rear end of the nose portion in a direction generally along the long axis of said nose portion;

(c) a first generally planar wing portion and a second generally planar wing portion, wherein each of said wing portions:

(i) depends from the rear end of the nose portion;

(ii) depends from the rib;

(iii) has a tapered outer edge; and wherein the plane of the first wing portion is generally parallel to and spaced apart from the plane of the second wing portion, and the taper of the outer edge of the first wing portion is oppositely disposed to that of the second wing portion.

2. The aerial toy of claim 1, wherein the nose portion has a first side and a second side, a notch across the short axis of the first side near the from end, and an appendage adjacent to said notch, and wherein the notch and the appendage are adapted for receiving the elastomeric band of a launcher.

3. The aerial toy of claim 1, wherein each of the wing portions is of increasing width from a first point adjacem to the nose portion to a second point near the end of the rib away from the nose portion.

4. The aerial toy of claim 1, which is adapted to route about an axis defined by its rib as it ascends after launch to its maximum altitude, and to route about an axis defined by its rib as well as about an axis passing through its center of mass and generally through the center of mass of the Earth as it descends from its maximum altitude.

5. The aerial toy of claim 1, which is made from a material selected from the group consisting of polyethylene, polypropylene, urethane foam and styrene foam.

6. The aerial toy of claim 1, wherein the rib provides a pair of angled substantially planar transitions from the first wing portion to the second wing portion.

7. The aerial toy of claim 6, wherein the transitions are parallel and are disposed at an angle within the range of about 30° to about 60° between the plane of the first wing portion and the plane of the second wing portion.

8. The aerial toy of claim 1, wherein approximately 30–49% of the total mass thereof is in the nose portion.

9. The aerial toy of claim 8, the center of mass of which is located on the rib just behind the nose portion.

10. An airfoil that is adapted to be launched into the air, said airfoil including:

(a) a nose portion that is generally in the shape of an elongate ellipsoid, said nose portion having a front end and a rear end and comprising approximately 30–49% of the total mass of the airfoil;

(b) an elongate rib depending from the rear end of the nose portion in a direction generally along the long axis of said nose portion;

(c) a first generally planar wing portion and a second generally planar wing portion, wherein each of said wing portions:

(i) depends from the rear end of the nose portion;

(ii) depends from the rib;

(iii) has a tapered outer edge; and wherein:

(d) the plane of the first wing portion is generally parallel to and spaced apart from the plane of the second wing portion;

(e) the taper of the outer edge of the first wing portion is oppositely disposed to that of the second wing portion;

(f) the location of the center of mass of the airfoil is on the rib just behind the nose portion;

(g) the airfoil is adapted to rotate about an axis defined by its rib as it ascends after launch to its maximum altitude, and to rotate about an axis defined by its rib as well as about an axis passing through its center of mass and generally through the center of mass of the Earth as it descends from its maximum altitude.

11. The airfoil of claim 10, wherein each of the wing portions is of increasing width from a first point adjacent to the nose portion to a second point near the end of the rib away from the nose portion.

12. The airfoil of claim 10, which is made from a material selected from the group consisting of polyethylene, polypropylene, urethane foam, styrene foam and paper.

13. The airfoil of claim 10, which is adapted to be launched into the air using an elastomeric band.

14. The airfoil of claim 13, wherein the nose portion has a first side and a second side, a notch across the short axis of the first side near the front end, and an appendage adjacent to said notch, and wherein the notch and the appendage are adapted for receiving the elastomeric band of a launcher.

15. The airfoil of claim 10, wherein the rib provides a pair of angled substantially planar transitions from the first wing portion to the second wing portion.

16. The airfoil of claim 15, wherein the transitions are parallel and are disposed at an angle of approximately 45° between the plane of the first wing portion and the plane of the second wing portion.

* * * * *

UNITED STATES PATENT AND TRADEMARK OFFICE

CERTIFICATE OF CORRECTION

PATENT NO. : 5,690,533

DATED : November 25, 1997

INVENTOR(S) : Robert Dean Harris and David Edward Barry

It is certified that error appears in the above-identified patent and that said Letters Patent is hereby corrected as shown below:

Title page,

At line 5 of the Abstract, replace the word "dkection" with the word "direction".

At line 50 of column 1, replace the word "taft" with the word "tail".

At line 49 of column 2, replace the word "Mother" with the word "Another".

At line 58 of column 5, in claim 2, replace the word "from" with the word "front".

At line 62 of column 5, in claim 3, replace the word "adjacem" with the word "adjacent".

At line 64 of column 5, in claim 4, replace the word "route" with the word "rotate".

At line 66 of column 5, in claim 4, replace the word "route" with the word "rotate".

At line 49 of column 3, replace the word "Found" with the word "ground".

Signed and Sealed this

Tenth Day of February, 1998

*Attest:*

*Attesting Officer*

BRUCE LEHMAN

*Commissioner of Patents and Trademarks*